United States Patent [19]

Nighswonger et al.

[11] 4,128,193

[45] Dec. 5, 1978

[54] PRESSURIZED COATING CONTAINER WITH DEPTH OF COLOR INDICATOR

[76] Inventors: James Nighswonger, c/o George Spector, 3615 Woolworth Bldg., 233 Broadway; George Spector, 3615 Woolworth Bldg., 233 Broadway, both of New York, N.Y. 10007

[21] Appl. No.: 811,693

[22] Filed: Jun. 30, 1977

[51] Int. Cl.[2] ..... B65D 83/14; B05B 11/00

[52] U.S. Cl. ..... 222/402.21; 116/114 AJ; 116/129 F; 118/9; 239/71; 401/194; 427/8

[58] Field of Search ..... 118/4, 8, 9, 10; 427/8, 427/9, 10; 116/114 R, 114 AJ, 129 F, 129 E, 129 R, 125, 117 C; 239/71, 74, 602; 356/192, 243, 256; 401/5, 190, 292, 194, 137; 222/402.21, 575

[56] References Cited

U.S. PATENT DOCUMENTS

| | | | |
|---|---|---|---|
| 2,579,150 | 12/1951 | Leopold et al. | 239/71 X |
| 2,619,381 | 11/1952 | Jepson | 239/71 X |
| 2,794,679 | 6/1957 | Jauch et al. | 239/71 X |
| 3,938,550 | 2/1976 | Hechler | 239/74 X |

*Primary Examiner*—Morris Kaplan

[57] ABSTRACT

A pressurized spray can contain a colorant coating stuff which varies in color intensity directly with the amount applied to a substrate, as for instance a photochromic material, is combined with a movable indicator of a color matching the colorant and graduated in depth of color (intensity) matching those applicable to the coated substrate. The indicator is mounted on the container and disposed in the line of operator vision when the container is functionally positioned so that the operator simultaneously views both the substrate and the selected indicator portion.

1 Claim, 5 Drawing Figures

PRESSURIZED COATING CONTAINER WITH DEPTH OF COLOR INDICATOR

This invention relates generally to anti-glare devices.

A principal object of the present invention is to provide a means whereby a chemical can be conveniently sprayed on any window surface in order to block out a glare of brilliant light rays.

Another object is to provide a means which accordingly would be ideal for use by motorists, airplane pilots or railroad engineers for applying to windshields in order to block out glare from a sun or other strong lights from ahead, and which would be suitable also for windows of homes, offices or factories.

Other objects are to provide non-glare windows which is simple on design, inexpensive to manufacture, rugged in construction, easy to use and efficient in operation.

These and other objects will be readily evident upon a study of the following specification and the accompanying drawing wherein.

Figure 1:
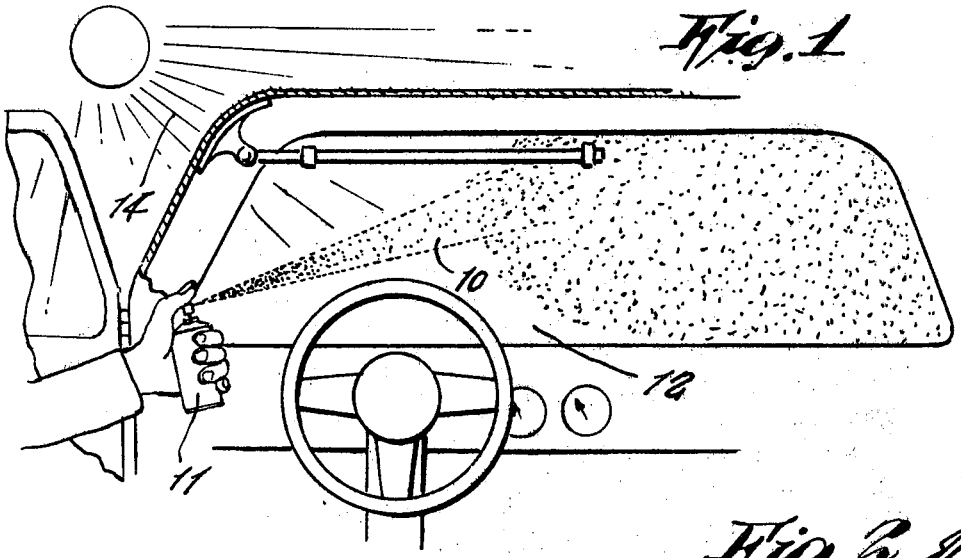
FIG. 1 is a view of a photochromic substance being sprayed from a pressure can onto a windshield.
Figure 2:
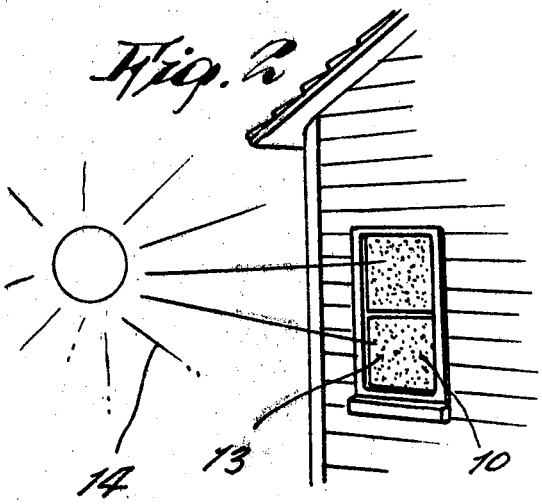
FIG. 2 shows it applied on a window of a house.
Figure 3:
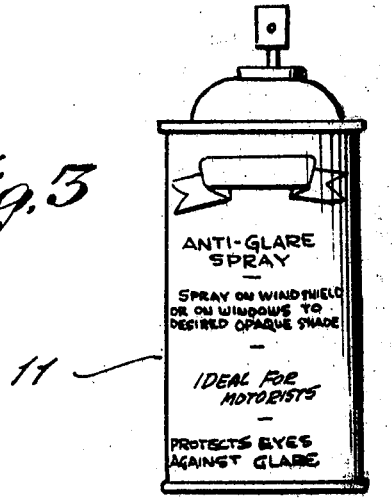
FIG. 3 is a side view of the can containing the photochromic substance.

Referring now to the drawing in greater detail, and more specifically to FIGS. 1 to 3 thereof at this time, the reference number 10 represents a chemical for being applied to transparent surfaces of glass, plastic or the like, in order to block out the passage of glaring light rays therethrough or at least causing them to be dimmed any desired amount by simply applying a thicker coating thereof.

The chemical 10 can comprise a photochromic substance which is used in photograpy so to block out selectively the intensity of light ray glare.

The chemical could be contained in pressurized cans 11 so to be handy for application by any person. As shown in the drawing, it would be sprayed on an inner surface of any vehicle windshield 12, or a window 13 of any home or building so to arrest the passage of brightest light rays 14.

Figure 4:
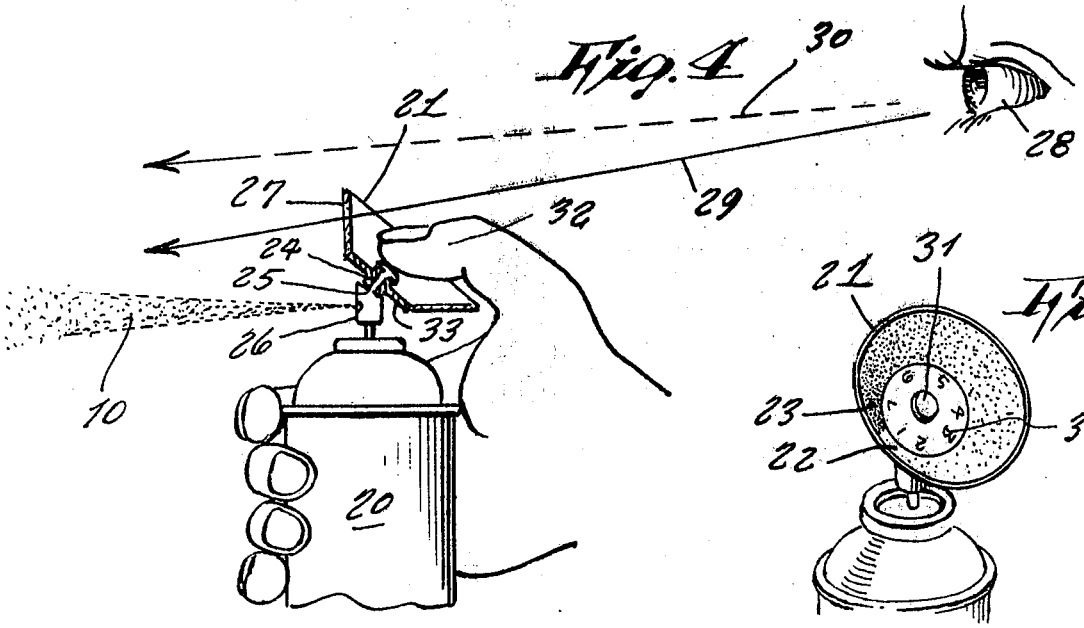
FIG. 4 is a side view of another model of the spray can which includes a gauge for aiding a person to apply a coat of photochromic substance that is evenly opaque throughout its entire area.
Figure 5:
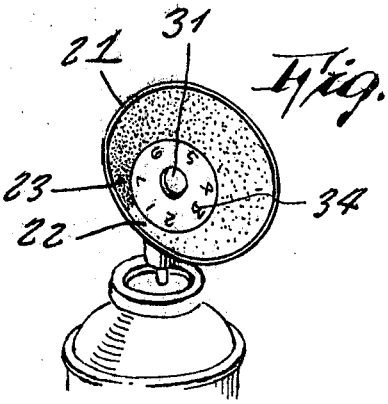
FIG. 5 is a perspective view of the gauge used in FIG. 4.

In FIGS. 4 and 5, a modified design of spray can 20 is shown to include a conically shaped gauge 21 that indicates a shade intensity ranging from a minimum to a maximum of opaqueness as indicated from 22 to 23. The gauge is formed with a central opening 24 so to freely pivot on a projection 25 formed at a 45 degree angle on the upper end of a spray nozzle 26 of the can so that the gauge includes a forward portion 27 of the conical gauge extending vertically upright in order that a person's eye 28 can see therethrough during a spraying action, as indicated by arrow 29, while at a same time the eye can see around the peripheral edge of the gauge so to see directly the sprayed surface, as shown by arrow 30 so to be guided to produce a same intensity of shading throughout the sprayed area as is indicated by the selected shade intensity portion of the gauge. A slightly rounded head 31 on the end of the projection 25 retains the gauge thereon, and provides a surface on which a person's thumb 32 can be placed for depressing the nozzle in order to eject a spray of the chemical 10. A circular flat wall 33 integral with the edge of the pointed end of the conical gauge is provided with calibrated numerals 34 so to aid in positioning the gauge at a selected shade intensity. While various changes may be made in the detail construction, it is understood that such changes will be within the spirit and scope of the present invention, as is defined by the appended claims.

What is claimed is:

1. An applicator device comprising in combination:

a pressurized container of the hand held, sprayer type having a photochromic coating material therein;

said coating material being of a type wherein depth of color produced due to light thereon, when applied to a substrate, varies with the thickness of coating;

a movable indicator of a color matching said color produced and graduated in intensity between limits matching those applicable to the coated substrate; and said indicator being mounted on said container and disposed in the line of operator vision when the container is in functional coating position;

whereby said operator simultaneously views both the selected indicator intensity and the depth of color produced on said substrate which is due to the effect of light the quantity of said coating material being applied.

* * * * *